US006145672A

United States Patent [19]

Bachman et al.

[11] Patent Number: 6,145,672

[45] Date of Patent: Nov. 14, 2000

[54] MEMORIAL DISPLAY UNIT AND METHOD FOR DISPLAYING MEMORIALS

[75] Inventors: Douglas E. Bachman, Columbus, Ohio; Lynn A. Taggart, Marblehead, Mass.; Alton F. Doody, New Orleans, La.

[73] Assignee: The York Group, Inc., Houston, Tex.

[21] Appl. No.: 09/258,778

[22] Filed: Feb. 26, 1999

Related U.S. Application Data

[63] Continuation-in-part of application No. 09/205,080, Dec. 4, 1998, Pat. No. 6,070,741.

[51] Int. Cl.[7] ..... A47F 5/00

[52] U.S. Cl. ..... 211/13.1; 211/85.16; 211/85.27; 211/90.02; 211/90.04

[58] Field of Search ..... 211/85.16, 13.1, 211/85.27, 90.01, 90.04, 45, 187, 189, 90.02

[56] References Cited

U.S. PATENT DOCUMENTS

| | | | |
|---|---|---|---|
| D. 350,246 | 9/1994 | Louise et al. | D6/479 |
| D. 351,076 | 10/1994 | Eliadis et al. | D6/476 |
| D. 397,562 | 9/1998 | De Potley et al. | D6/468 |
| 2,580,334 | 12/1951 | Janderveld | 211/189 X |
| 3,190,243 | 6/1965 | Pira | 108/152 |
| 3,585,944 | 6/1971 | Scheer | 108/111 |
| 4,119,207 | 10/1978 | Pullen et al. | 211/189 X |
| 4,197,950 | 4/1980 | Quitz | 211/45 X |
| 4,891,897 | 1/1990 | Gieske et al. | 40/618 |
| 4,925,038 | 5/1990 | Gajewski | 211/59.2 |
| 5,370,249 | 12/1994 | Harvey et al. | 211/189 |
| 5,405,017 | 4/1995 | Szabo et al. | 211/13.1 |
| 5,495,954 | 3/1996 | Schmit | 211/190 |
| 5,622,010 | 4/1997 | Weber | 52/36.4 |
| 5,702,011 | 12/1997 | Canoll | 211/189 X |
| 5,711,115 | 1/1998 | Wirt | 52/36.3 |
| 5,759,045 | 6/1998 | Gabig et al. | 434/367 |
| 5,775,034 | 7/1998 | Logue | 52/36.1 |
| 5,797,499 | 8/1998 | Pinco | 211/13.1 |
| 5,901,862 | 5/1999 | Riga et al. | 211/85.16 |

OTHER PUBLICATIONS

Quarter Coffin Designs Practiced in France (photos attached).

*Primary Examiner*—Robert W. Gibson, Jr.
*Attorney, Agent, or Firm*—Stevens, Davis, Miller & Mosher, L.L.P.

[57] ABSTRACT

A memorial merchandise display unit and method of displaying the unit that maximizes the types and styles of memorial merchandise comprising two vertical, parallel, spaced wing walls and a vertical back wall attached to a rear end of each wing wall. Attached to the back wall and/or the wing walls is at least one angled display board to engage the line of sight of a prospective purchaser and provide a location for the multi-planar display of a variety of memorial merchandise, death care merchandise, decedent confinement chambers, vases, and visual materials. Additionally, the unit may further contain a cornice and/or at least one illumination source to improve the visibility and notoriety of the memorial merchandise.

Alternatively, at least two display units are combined to create a modular memorial merchandise display unit capable of depicting a plurality of death care merchandise, decedent confinement chambers, and visual materials design lines. This configuration allows the consumer an opportunity to compare a plurality of death care merchandise design lines in one setting.

22 Claims, 5 Drawing Sheets

MEMORIAL DISPLAY UNIT AND METHOD FOR DISPLAYING MEMORIALS

SPECIFICATION

This is a continuation-in-part application of U.S. patent application Ser. No. 09/205,080 filed Dec. 4, 1998, now U.S. Pat. No. 6,070,741, entitled "Memorial Death Care Merchandise Display Unit and Method for Displaying Death Care Merchandise" filed by the same inventors.

FIELD OF THE INVENTION

The present invention relates to an integrated display unit and a method of displaying the unit for memorial merchandise, such as bronze memorials or markers. The display systems of the invention are particularly designed for use by prospective purchasers in a preview room.

BACKGROUND OF THE INVENTION

Modern techniques of displaying death care merchandise include U.S. Pat. No. 759,045, which discloses a product display board capable of displaying multiple product display lines. By arranging three product lines in rows along the board, the '045 Patent offers a comparison of the options available to those in the market for death care merchandise. However, this display fails to provide for the display of memorial merchandise (such as bronze memorials or markers) in more than one plane, a more attention grabbing and appealing method of display. Additionally, this display system fails to angle the memorial merchandise in the line of sight of the prospective purchaser, thus better engaging the prospective purchaser. Finally, the '045 Patent does not offer illumination to aid in a purchaser's consideration.

The need exists therefore for a display system which permits the exhibition of a greater volume and a greater type of death care or memorial merchandise with greater ease on the prospective purchaser. In addition, the need exists for a display system which can be more easily assembled and utilized than afforded by the systems of the prior art that will more easily engage the attention of prospective purchasers of memorial merchandise and provide a method of display that allows the prospective purchaser to consider various design lines of memorial merchandise and visual materials.

SUMMARY OF THE INVENTION

A memorial display unit and a method of displaying the unit that maximizes the types and styles of memorial merchandise comprising two vertical, parallel, spaced wing walls and a vertical back wall attached to a rear end of each wing wall. Attached to the back wall and/or the wing walls is at least one panel bracket that supports at least one angled display board to engage the line of sight of a prospective purchaser and provide a location for the multi-planar display of a variety of memorial merchandise and visual materials.

The display unit may further contain a cornice. The cornice can present information for the purposes of indication and identification of the memorial merchandise being displayed. Alternatively, the cornice provides a location for attaching visual materials. In a preferred embodiment, the cornice is attached to a front edge of each wing wall. Alternatively or additionally, the cornice can attach to the back wall. The display unit may also comprise at least one illumination source to improve the visibility and notoriety of the memorial merchandise and visual materials being displayed. In a preferred embodiment of the invention, a plurality of illumination sources are attached to all inside or bottom surface of the cornice and behind each angled display board.

Furthermore, the back wall may contain a plurality of parallel, spaced slats. These slats are evenly spaced to allow the insertion of at least one fastener, preferably a J-hook fastener, into the plurality of slots created by the uniform arrangement of the slats attached to the back wall. This configuration allows each angled display board assembly and possibly a shelf equipped with an appropriate fastener to be inserted into at least one slot in the slat wall. This configuration offers the flexibility and convenience of allowing a multitude of configurations for the display of memorial merchandise and visual materials.

In a most preferred embodiment, at least two display units are combined to create a memorial merchandise display unit capable of depicting a plurality of memorial merchandise and visual materials design lines. This configuration allows the consumer an opportunity to compare a plurality of memorial merchandise design lines in one setting.

DETAILED DESCRIPTION OF THE PREFERRED EMBODIMENT

The present invention provides an integrated display system for memorial related merchandise, such as bronze memorials or markers. The display system of the invention is principally used in a preview room where the selection of death care related merchandise by the decedent's loved ones occurs. In addition, the display system of the present invention may be used in death related ceremonial areas such as the viewing room of a funeral home, in a store, as well as at funeral and memorial services. One of the principal advantages of the display system of the present invention is that it maximizes the number and types of memorial merchandise which may be displayed in a given area.

The display system of the invention may further be a modular assembly; permitting it to be assembled and disassembled within a short period of time as well as on an "as needed" basis. The ability of the display system to be modular permits purchasers to buy all or sections of the system when so desired. Additionally, the modular assembly allows the display of a plurality of designs of memorial merchandise and visual materials, thus allowing the prospective purchase to consider the comparable design lines.

Figure 1:
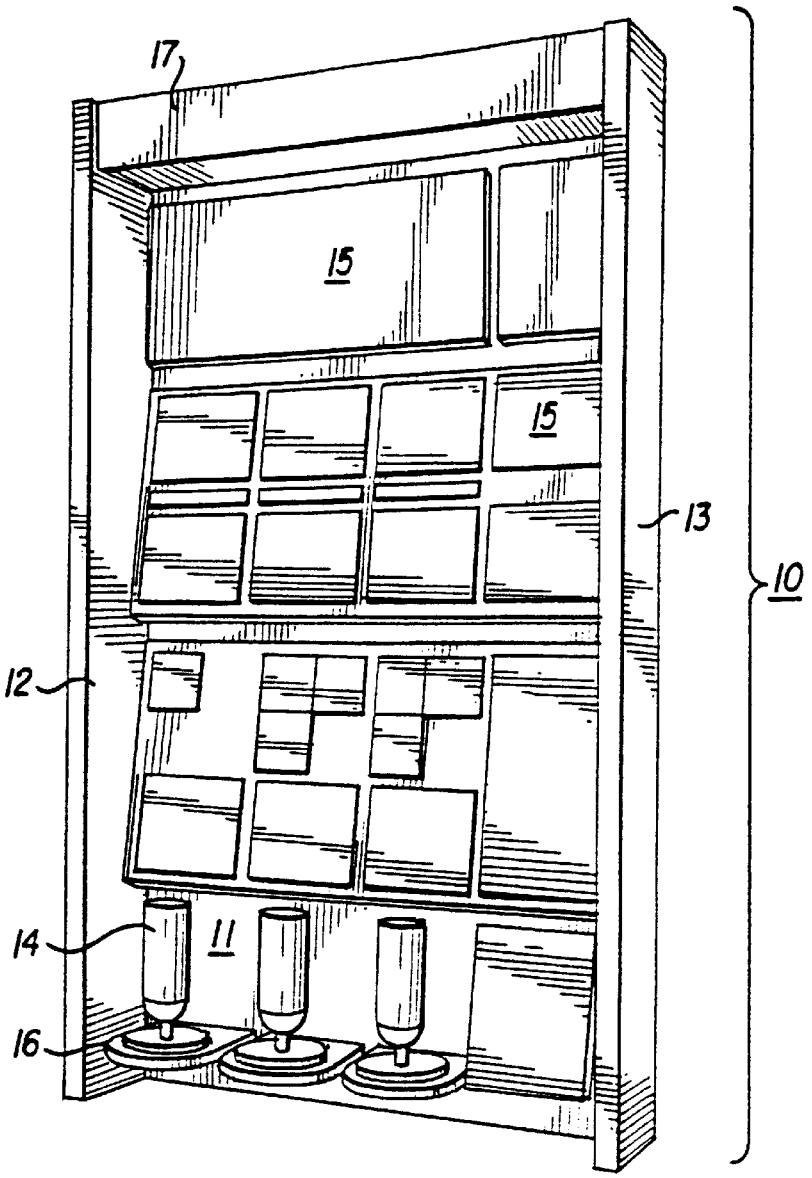
FIG. 1 is a perspective of the display unit.
Figure 3:
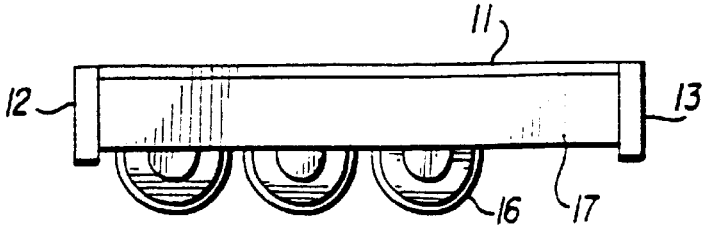
FIG. 3 is a plan view of the display unit.
Figure 2:
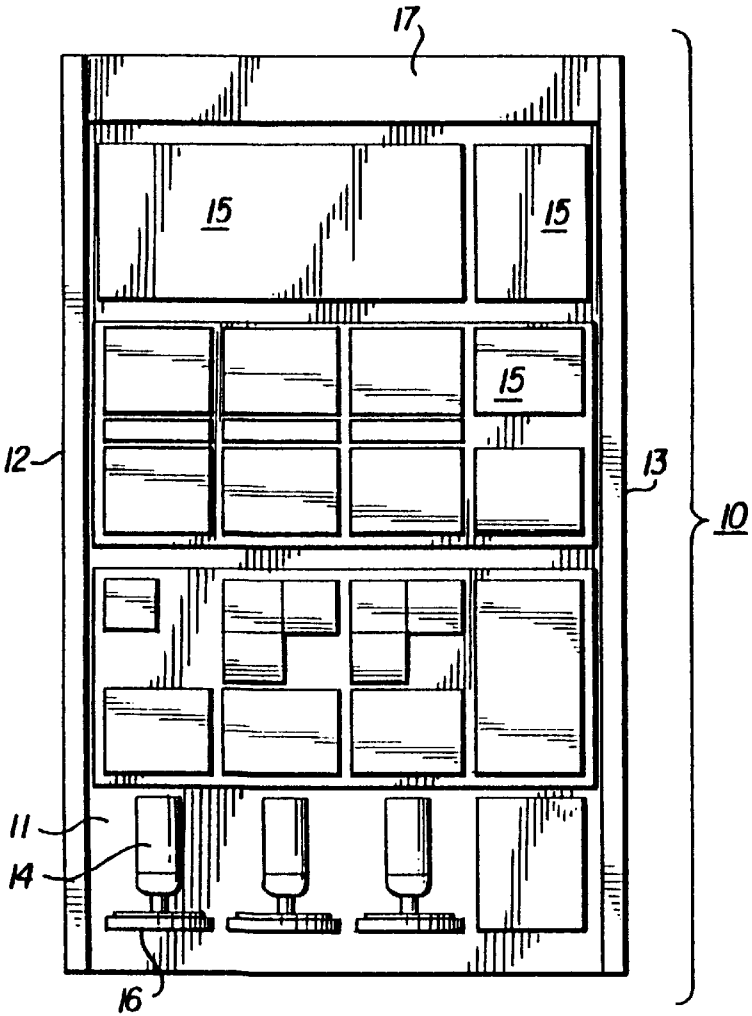
FIG. 2 is an elevation view of the display unit.

The present invention contains a number of novel features that may be used alone or in combination with each other. FIGS. 1, 2, and 3 show a perspective view, an elevation view, and a plan view, respectively, of a memorial merchandise display unit 10. The display unit 10 comprises a back wall 11 and two wing walls 12 and 13 that are arranged such that they have facing surfaces and opposing surfaces. The wing walls 12 and 13 are attached to the back wall 11 at the rear end of each wing wall 12 and 13. Alternatively, the back wall 11 may be removably secured to the rear end of the wing walls 12 and 13.

The back wall 11 and the wing walls 12 and 13 of the display unit 10 are typically plywood but may be fiberwood or other durable material such as a plastic material as plexiglass or Mylar. The back wall 11 and/or the wing walls 12 and 13 may be covered with a fabric-like material, covered with plastic laminate, or have a textured surface.

The back wall 11 and the wing walls 12 and 13 provide a location for one or more memorial related materials 15 such as cemetery memorials or grave markers (including but not limited to bronze memorials, granite memorials, wood memorials, plastic memorials, or metal memorials, having a variety of printed, chiseled, engraved, or etched designs and lettering) and/or visual materials such as drawings, placards, logos, descriptions, signs, texts, photographs, and materials for advertising the bronze memorials. These visual materials are used to inform prospective purchasers of features of the displayed memorial merchandise. The materials 15 are preferably attached by attachments that include peg-board type attachments, slat wall attachments described below, tackable surfaces, hook-and-loop fabric (e.g., VELCRO®) attachments, magnetic attachments, or other known devices for removably attaching objects to a surface for display of the objects. Alternatively, the materials 15 can be more permanently attached by adhesives or mechanical means including brackets, screws, bolts, nails, rivets, or other known devices for attaching objects to a surface for display. Any of the visual materials may comprise information about either the decedent (where the unit is employed in memorial settings or funerals) or the merchandise displayed (where the unit is employed for point-of-sale merchandise). For instance, in point-of-sale merchandise, the information center can display information about the materials used in the manufacture of the bronze memorials as well as information about the merchandise on display, such as size dimensions. In the preferred embodiment, some of these visual materials provide information about the design line of the memorial merchandise being displayed.

Additionally, the alcove defined by the back wall 11, the left wing wall 12, and the right wing wall 13 can display one or more vases 14. When used in a preview room display setting, each of the vases 14 may be displayed with any memorial merchandise, any visual materials, or other communicative materials that provide information to the prospective purchaser of the memorial merchandise 15 or vases 14.

The back wall 11 and the wing walls 12 and 13, as illustrated in FIGS. 1, 2, and 3 are typically 5 to 7 feet, preferably 6 feet, tall. Though a plurality of vases are shown in FIGS. 1, 2, and 3, the width of the back wall 11 can be wide enough to display an actual size vase 14. In the preferred embodiment of the invention, however, the back wall 11 of the display unit 10 is approximately four feet wide.

The vases 14 may be easily mounted onto the back wall 11 or the wing walls 12 and 13 of the display unit 10. In the preferred embodiment, at least one shelf 16 can be attached to the back wall 11 or the wing walls 12 and 13. Though any of the methods of removable or permanent attachment described above are applicable to the attachment of the shelf, the preferred embodiment of the invention uses a fastener inserted into at least one slot formed in a slat wall configuration. The slat wall configuration comprises a plurality of uniform, parallel slats attached to the back wall and/or the wing walls to form a plurality of uniform slots for the insertion of fasteners. The shelves 16 further comprise at least one fastener, preferably a J-hook fastener, that can be inserted within the recessed slots defined by the slat wall. Alternatively, elbow shelving joining adjacent slots may further be used in place of shelving 16. The elbow shelving comprises a horizontally flat section, and a support, angled to fit into the adjacent slot. Moreover, memorial merchandise, death care merchandise, decedent confinement chambers, and/or visual materials may also be displayed on the flat section formed.

This shelf 16 provides a support for any form of death care merchandise, but preferably provides support for at least one vase 14. In FIGS. 1, 2, and 3, a plurality of vases 14 are shown, being supported by a corresponding plurality of shelves 16 that are attached to the back wall 11 of the display unit 10.

The display unit 10 may further comprise a cornice 17. Any conventional cornice or soffit disclosed in the art may suffice. For instance, the preferred cornice 17 comprises a horizontal beam which attaches to a front end of both wing walls 12 and 13. Alternatively, the cornice 17 can comprise a left cantilevered vertical beam and a right cantilevered vertical beam extending from the back wall 10. A horizontal beam is attached to the frontmost lateral edges of the vertical beams. Typically, the cornice 17 will increase the height of the display unit 10 to above 7 feet.

Figure 4:
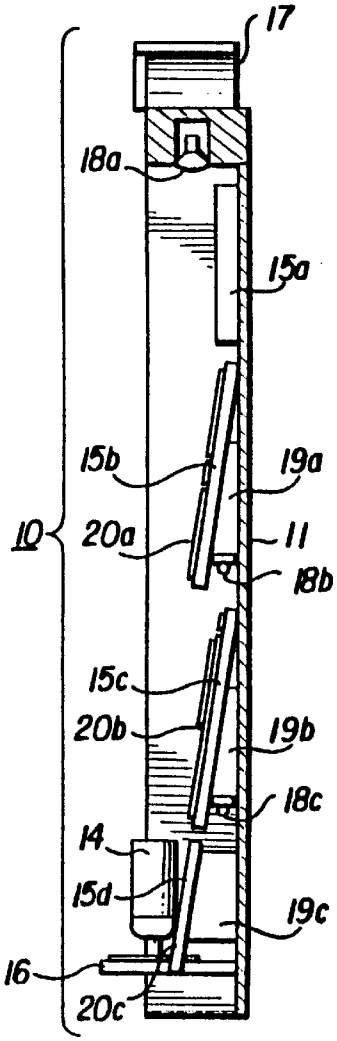
FIG. 4 is a sectional side view of the display unit.

As shown in FIG. 4, the display unit 10 may also comprise a plurality of panel brackets 19*a*, 19*b*, and/or 19*c* that are either removably or permanently attached to the back wall 11 and/or the wing walls 12 and 13. At least one angled display board 20*a*, 20*b*, and/or 20*c* can be attached directly to the back wall 11 and/or the wing walls 12 and 13 or preferably to at least one panel bracket 19*a*, 19*b*, and/or 19*c* to provide a visually appealing location for the attachment of memorial merchandise 15*a*, 15*b*, 15*c*, and/or 15*d* such that the angled display board has a slope that is not parallel to the plane of the back wall 11. Though any of the permanent or removable methods of attachment previously described are appropriate, the preferred embodiment comprises fasteners, most preferably J-hook fasteners, on a rear portion of the panel brackets 19*a*, 19*b*, and/or 19*c* that are inserted into at least one slot of a slat wall configuration on the back wall 11 or the wing walls 12 and 13. By presenting the memorial merchandise, the vases 14, and/or the visual materials in a plurality of planes to the prospective purchaser, they can be also be effectively illuminated.

The display unit 10 may further comprise at least one illumination source 18*a*, 18*b*, 18*c*, and/or 18*d*. The illumination source 18*a*, 18*b*, 18*c*, and/or 18*d* may be concealed to the observer within the interior or bottom surface of the cornice 17, if included, or behind any angled display board 20*a*, 20*b*, and/or 20*c*. Exemplary of the illumination sources 18*a*, 18*b*, 18*c*, and/or 18*d* available are integrated lights, candescent lights, fluorescent lights, track lights, or pendant lights. Practically any light source that may easily be manipulated such that the light is directed onto selected memorial merchandise, vases 14, or visual materials will suffice. The illumination source 18*a*, 18*b*, 18*c*, and/or 18*d* is attached by one of the attachment means previously described to a bottom or inside surface of the cornice 17, if included, and behind any angled display board 20*a*, 20*b*, and/or 20*c*.

As set forth in FIG. 4, a plurality of illumination sources 18*a*, 18*b*, and 18*c* are attached to the bottom surface of the cornice 17 and behind the angled display boards 20*a* and 20*b*, respectively, to provide light on any display of memorial merchandise, vases 14, or visual materials within the display unit 10. In this preferred embodiment, by providing a plurality of angled display boards 20*a*, 20*b*, and 20*c* attached to a plurality of panel brackets 19*a*, 19*b*, and 19*c*, respectively, the visual materials 15*b*, 15*c*, and 15*d* are equally noticed as the visual materials 15*a* presented at the approximate eye level of the prospective purchaser. By illuminating all visual materials 15*a*, 15*b*, 15*c*, and 15*d* equally, the prospective purchaser is presented with an engaging display unit 10 while considering his or her purchase options.

A plurality of chambers are formed behind any angled display board 20*a*, 20*b*, and/or 20*c* and the back wall 11. Additionally, another chamber is formed by the cornice 17, when included, and the back wall 11. These chambers provide a location to store any necessary electrical cable wiring. The wiring can be routed through at least one aperture formed, drilled, cut, or punctured in the back wall 11. The electrical wiring is not evident to the prospective purchaser.

Figure 5:
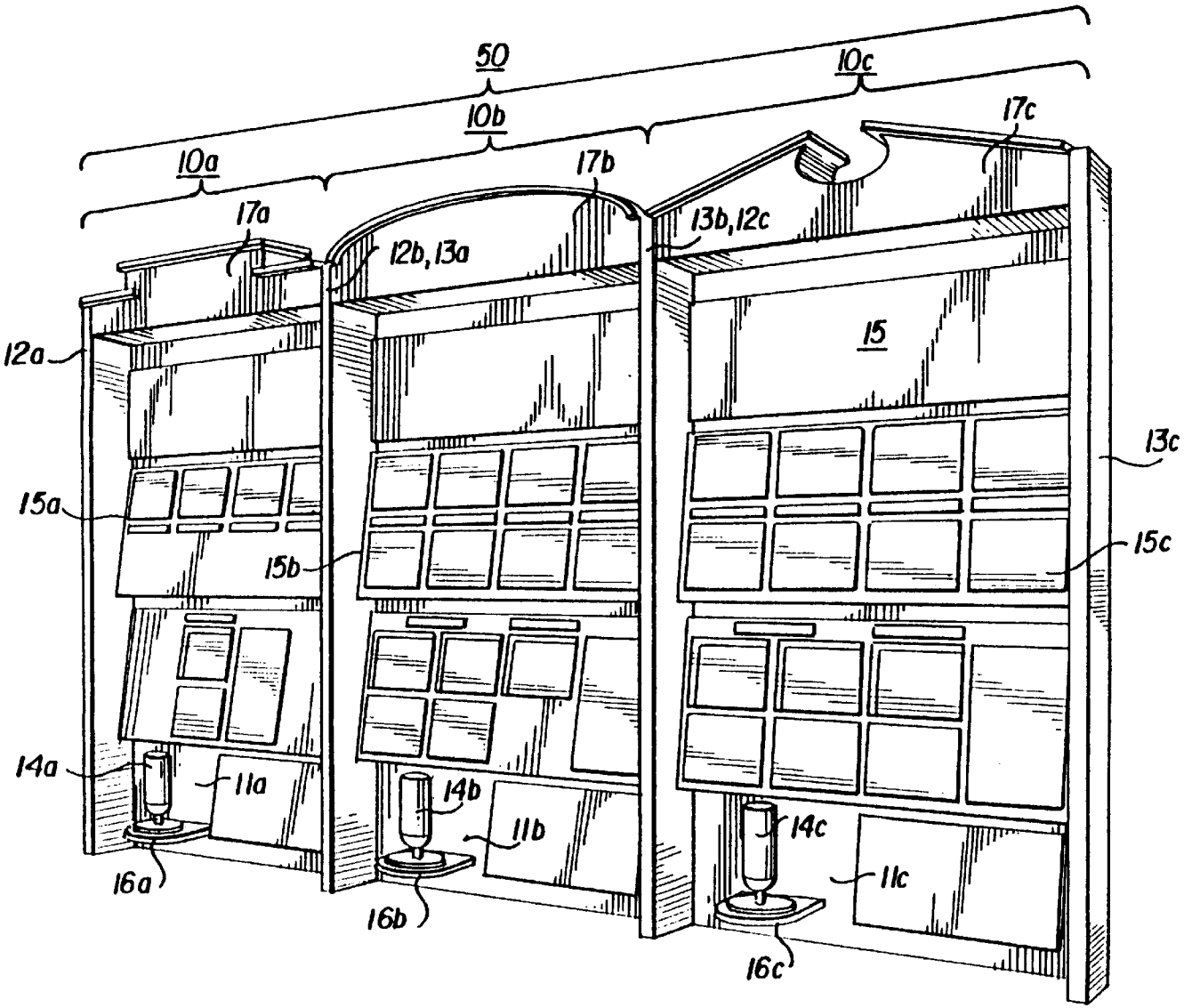
FIG. 5 is a perspective view of a preferred embodiment of the display unit in a modular configuration.
Figure 6:
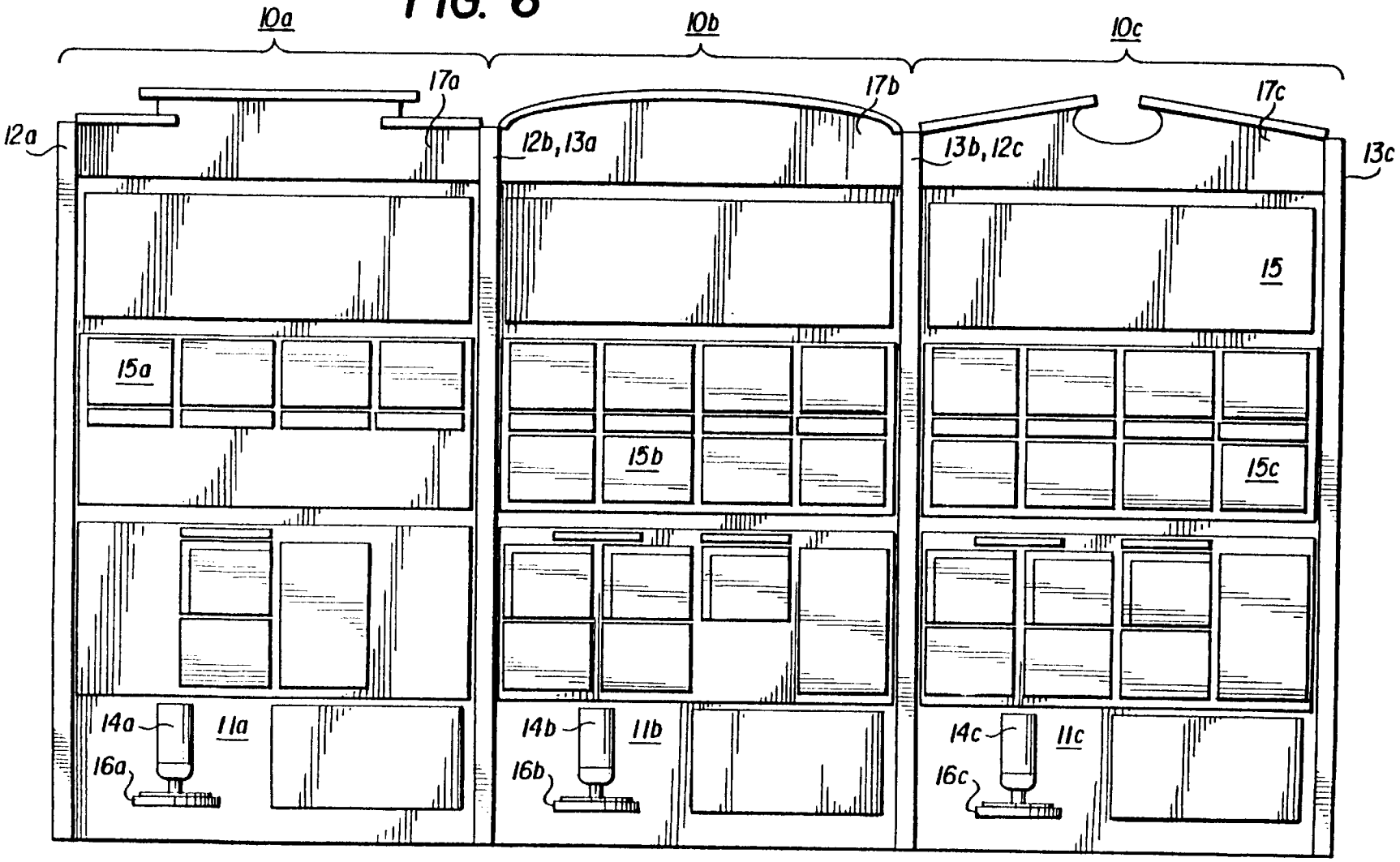
FIG. 6 is an elevation view of a preferred embodiment of the display unit in a modular configuration.
Figure 7:
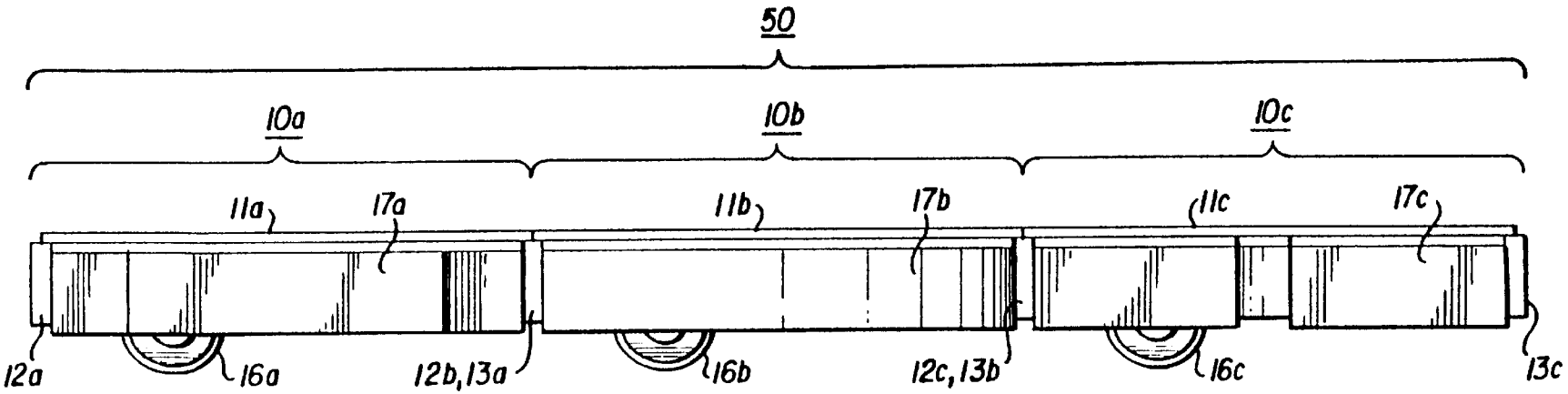
FIG. 7 is a plan view of a preferred embodiment of the display unit in a modular configuration.

Additionally, as shown in a preferred embodiment in FIGS. 5, 6, and 7, a display unit 10*a* can be either permanently or removably attached to at least one other display unit 10*b* to provide a modular display unit 50. In this configuration, a plurality of display units 10*a*, 10*b*, and 10*c*, for example, are attached to one another at the wing walls 13*a* to 12*b* and 13*b* to 12*c*. Alternatively, the display units 10*a* and 10*b* can share a common wing wall 13*a* /12*b* and the display units 10*b* and 10*c* can share a common wing wall 13*b*/12*c*. Though this configuration reduces the flexibility of the modular display unit 50, less materials are required.

The modular display unit 50 allows more than one design line of memorial merchandise, vases, and/or visual materials to be displayed for the prospective purchaser's consideration. By altering the shape of the cornices 17*a*, 17*b*, and 17*c*, the modular display unit 50 can further distinguish the plurality of design lines being offered. As shown in FIGS. 5, 6, and 7, the materials 15*a*, 15*b*, and 15*c* can be displayed so that a prospective purchaser can effectively consider the quality and merits of several different design lines of memorial merchandise, vases, and/or visual materials to make a more efficient and more informed decision. The modular display unit 50 allows the mixing or matching of various display units 10 as well as allowing the subsequent purchase of additional display units 10 to offer additional design lines or more of the design lines presently being offered in the modular display unit 50.

Various modifications may be made in the nature, composition, operation and arrangement of the various elements, steps and procedures described herein without departing from the spirit and scope of the invention as defined in the following claims.

What is claimed is:

1. A merchandise display unit comprising a display area formed in front of a vertical back wall having a front surface and between two vertical, parallel, spaced wing walls attached to said back wall at a rear end of each wing wall, said display unit further comprising a cornice and a plurality of display surfaces extending into the space formed between said vertical back wall and said spaced wing walls and below said cornice, said surfaces including at least one horizontal surface for displaying merchandise and at least one display board, said display board being angled with regard to said vertical back wall and having a slope that is neither parallel nor perpendicular to the plane of the vertical back wall.

2. The merchandise display unit of claim 1, in combination with at least one modular memorial merchandise display unit.

3. The merchandise display unit of claim 1, further comprising at least one item selected from the group consisting of memorial merchandise, death care merchandise, decedent confinement chambers, vases, and visual material displayed on said horizontal surfaces and on said display board.

4. The merchandise display unit of claim 1, wherein said cornice is attached to a front end of each wing wall.

5. The merchandise display unit of claim 1, wherein said cornice comprises a mounting member cantilevered from the back wall, the mounting member comprising two vertical panels and a horizontal beam secured to the vertical panels.

6. The merchandise display unit of claim 1, further comprising at least one illumination source attached behind at least one display board and at least one aperture in the back wall to provide a passageway for any electrical wiring from each illumination source to exit the memorial merchandise display unit.

7. The merchandise display unit of claim 4, further comprising at least one illumination source attached to an inside or bottom surface of the cornice and an aperture in the back wall to provide a passageway for any electrical wiring from each illumination source to exit the merchandise display unit.

8. The merchandise display unit of claim 1, further comprising at least one shelf attached to at least one of the back wall and said at least one wing wall and at least one decedent confinement chamber supported by the shelf.

9. The merchandise display unit of claim 1, further comprising:

a plurality of uniform, parallel slats attached to at least one of the back wall and at least one of the wing walls to form a plurality of uniform, parallel slots;

wherein each display board is fastened to at least one slot.

10. The merchandise display unit of claim 9, further comprising at least one item selected from the group consisting of memorial merchandise, death care merchandise, decedent confinement chambers, vases, and visual material displayed on said horizontal surface and on said display board.

11. The merchandise display unit of claim 9, further comprising a shelf fastened to at least one slot and at least one vase supported by the shelf.

12. The memorial merchandise display unit of claim 2, further comprising at least one item selected from the group consisting of memorial merchandise, death care merchandise, decedent confinement chambers, vases, and visual material displayed in said at least one modular memorial merchandise display unit.

13. The memorial merchandise display unit of claim 2, further comprising at least one of a first cornice attached to a front end of the wing walls of the first modular memorial merchandise unit and a second cornice is attached to a front end of the wing walls of the second modular memorial merchandise unit.

14. The memorial merchandise display unit of claim 2, further comprising:

at least one illumination source attached behind at least one display board of the merchandise display unit and at least one aperture in the back wall of the merchandise display unit to provide a passageway for any electrical wiring from the illumination source to exit the merchandise display unit; and at least one illumination source in said modular memorial merchandise display unit and at least one aperture in the back wall of said modular memorial merchandise display unit to provide a passageway for any electrical wiring from the illumination source to exit said modular memorial merchandise display unit.

15. The memorial merchandise display unit of claim 2, further comprising:

a plurality of uniform, parallel slats attached to at least one of the back wall and the wing walls of either the merchandise display unit and said modular memorial merchandise display unit to form a plurality of uniform, parallel slots;

and at least one display board is fastened into at least one slot.

16. The memorial merchandise display unit of claim 13, wherein said at least one said cornice attached to a front end of the wing walls of the merchandise unit and said second cornice attached to a front end of the wing walls of said modular memorial merchandise unit further comprise at least one illumination source.

17. The memorial merchandise display unit of claim 16, further comprising at least one item selected from the group consisting of memorial merchandise, death care merchandise, decedent confinement chambers, vases, and visual materials.

18. The memorial merchandise display unit of claim 16, further comprising a plurality of shelves fastened into at least one slot and at least one vase supported by each shelf.

19. The merchandise display unit of claim 1, wherein the space in front of said back wall and between said wing walls provide a location for displaying at least one memorial related material selected from the group consisting of cemetery memorials, grave markers, vases and visual materials.

20. The merchandise display unit of claim 19, wherein the visual materials are selected from the group consisting of drawings, placards, logos, descriptions, signs, text, photographs, and advertising materials.

21. The merchandise display unit of claim 19, wherein the cemetery memorials are selected from the group consisting of bronze, granite, wood, plastic and metal memorials.

22. A method of displaying death care merchandise which comprises forming a backdrop for said death care merchandise between at least a vertical back wall and two side walls providing display units within a space formed between said back wall and said side walls, said display units comprising at least one horizontal surface and at least one sloped surface, which slope is neither parallel nor perpendicular to a plane of said vertical back wall and displaying said death care merchandise on said horizontal surface and displaying on said sloped surface at least one material selected from cemetery memorials, grave markers and visual materials.

* * * * *